US011222601B2

(12) United States Patent
Kim et al.

(10) Patent No.: US 11,222,601 B2
(45) Date of Patent: Jan. 11, 2022

(54) DISPLAY DEVICE

(71) Applicant: Samsung Display Co., Ltd., Yongin-si (KR)

(72) Inventors: Won Tae Kim, Yongin-si (KR); Sun Koo Kang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/797,488

(22) Filed: Feb. 21, 2020

(65) Prior Publication Data

US 2020/0312251 A1 Oct. 1, 2020

(30) Foreign Application Priority Data

Mar. 27, 2019 (KR) ..... 10-2019-0034992

(51) Int. Cl.
*G09G 3/3291* (2016.01)

(52) U.S. Cl.
CPC ... *G09G 3/3291* (2013.01); *G09G 2300/0426* (2013.01); *G09G 2310/08* (2013.01)

(58) Field of Classification Search
None
See application file for complete search history.

(56) References Cited

U.S. PATENT DOCUMENTS 7,233,322 B2 6/2007 Takehara et al.
2011/0037758 A1* 2/2011 Lim ..... H03L 7/0805 345/213
2017/0323611 A1 11/2017 Jo et al.
2020/0074952 A1* 3/2020 Tominaga ..... G09G 3/3677

FOREIGN PATENT DOCUMENTS

KR 10-0505773 B1 8/2005
KR 10-2017-0126568 A 11/2017

* cited by examiner

*Primary Examiner* — Stephen T. Reed
(74) *Attorney, Agent, or Firm* — Lewis Roca Rothgerber Christie LLP

(57) ABSTRACT

A display panel includes: a plurality of pixels connected to a plurality of data lines and a peripheral area at the periphery of the display area; a first channel group including a plurality of first shared channels respectively connected to shared data lines among the data lines; a second channel group including a plurality of second shared channels respectively connected to the shared data lines; a first source driver connected to the first channel group, the first source driver being configured to supply data signals to the shared data lines through the first channel group; and a second source driver connected to the second channel group, the second source driver being configured to supply the data signals to the shared data lines through the second channel group, wherein the first channel group and the second channel group forms a pair to be commonly connected the shared data lines.

20 Claims, 9 Drawing Sheets

DISPLAY DEVICE

CROSS-REFERENCE TO RELATED APPLICATION

The application claims priority to and the benefit of Korean patent application 10-2019-0034992 filed on Mar. 27, 2019 in the Korean Intellectual Property Office, the entire disclosure of which is incorporated herein by reference.

BACKGROUND

1. Field

Aspects of some example embodiments of the present disclosure generally relate to a display device.

2. Description of the Related Art

A display device transmits various types of data necessary for generation of a data signal to a data driver from a timing controller through an intra-panel interface established between the timing controller and the data driver. The data driver supplies a data signal to a display panel, and the display panel displays an image corresponding to the data signal.

Meanwhile, when the display device has a high image quality and a large area, the data driver includes a plurality of source drivers (or source driver ICs) configured to drive a plurality of sub-areas into which a display area is divided.

The above information disclosed in this Background section is only for enhancement of understanding of the background and therefore the information discussed in this Background section does not necessarily constitute prior art.

SUMMARY

Aspects of some example embodiments of the present disclosure generally relate to a display device, and for example, to a display device including a plurality of source drivers.

Some example embodiments include a display device including a plurality of source drivers configured to share some data lines and supply a data signal.

According to some example embodiments of the present disclosure, there is provided a display device including: a display panel including a display area provided with a plurality of pixels connected to a plurality of data lines and a peripheral area at the periphery of the display area; a first channel group including a plurality of first shared channels respectively connected to shared data lines among the data lines; a second channel group including a plurality of second shared channels respectively connected to the shared data lines; a first source driver connected to the first channel group, the first source driver supplying data signals to the shared data lines through the first channel group; and a second source driver connected to the second channel group, the second source driver supplying the data signals to the shared data lines through the second channel group, wherein the first channel group and the second channel group forms a pair to be commonly connected the shared data lines.

According to some example embodiments, the display panel may include: a plurality of connection lines in the peripheral area to connect one-to-one the first shared channels and the second shared channels; a first insulating layer to cover the connection lines; a plurality of pads on the first insulating layer, the plurality of pads being connected to the connection lines through contact holes penetrating the first insulating layer; and a second insulating layer covering side surfaces of the pads, the second insulating layer being on the first insulating layer. The first and second channel groups may be on the second insulating layer, and be in contact with each of the pads.

According to some example embodiments, a jth (j is a natural number) shared channel of the first channel group and a (k+1−j)th (k is a natural number of j or more) shared channel of the second channel group may be connected through one of the connection lines.

According to some example embodiments, the first and second channel groups may be consecutively arranged corresponding to the pads.

According to some example embodiments, the pads may include: first pads in contact with the respective first shared channels; and second pads in contact with the respective second shared channels.

According to some example embodiments, a first end portion of each of the connection lines may be connected to one of the first pads, and a second end portion of each of the connection lines may be connected to one of the second pads.

According to some example embodiments, the connection lines may be in the same layer.

According to some example embodiments, the display panel may include a plurality of shared fan-out lines extending from the first pads or the second pads to be respectively connected to the shared data lines.

According to some example embodiments, the number of the shared fan-out lines may be a half of the total sum of the numbers of the first and second shared channels. The number of the shared data lines may be the same as the number of the shared fan-out lines.

According to some example embodiments, the first source driver may include: a plurality of first output buffers electrically connected to the respective first shared channels; and a plurality of first switches respectively connected between the first output buffers and the first shared channels, the plurality of first switches being commonly controlled by a first control signal. The second source driver may include: a plurality of second output buffers electrically connected to the respective second shared channels; and a plurality of second switches respectively connected between the second output buffers and the second shared channels, the plurality of second switches being commonly controlled by a second control signal.

According to some example embodiments, the second switches may be turned off when the first switches are turned on, and the first switches may be turned off when the second switches are turned on.

According to some example embodiments, each of the first control signal and the second control signal may have a turn-on level in a predetermined frame period.

According to some example embodiments, in a first driving mode in which the first switches are turned on, the data signals may be supplied to the shared data lines through the first shared channels. In a second driving mode in which the second switches are turned on, the data signals may be supplied to the shared data lines through the second shared channels.

According to some example embodiments, the display device may further include a timing controller configured to serially supply first to kth image data corresponding to first to kth shared data lines to the first source driver in the first driving mode.

According to some example embodiments, in the second driving mode, the timing controller may supply the first to kth image data to the second source driver in reverse order of an arrangement order in the first driving mode.

According to some example embodiments, the timing controller may supply image data corresponding to the other data lines except the first to kth shared data lines to the first and second source drivers without reversing the arrangement order regardless of the driving mode.

According to some example embodiments, the display device may further include: a third channel group including third shared channels respectively connected to additional shared data lines; a fourth channel group including fourth shared channels respectively connected to the additional shared data lines; and a third source driver connected to the fourth channel group, the third source driver supplying data signals to the additional shared data lines through the fourth channel group. The third shared channels may be connected to the second source driver.

According to some example embodiments, in the first driving mode, the second source driver may supply the data signals to the additional shared data lines through the third shared channels. In the second driving mode, the third source driver may supply the data signals to the additional shared data lines through the fourth shared channels.

According to some example embodiments, the display device may further include: a plurality of first switches respectively connected between the first shared channels and a plurality of first output buffers included in the first source driver, the plurality of first switches being commonly controlled by a first control signal; and a plurality of second switches respectively connected between the second shared channels and a plurality of second output buffers included in the second source driver, the plurality of second switches being commonly controlled by a second control signal.

According to some example embodiments, the display panel may further include: first pads in the peripheral area of the display panel, the first pads being in contact with the first shared channels; second pads in the peripheral area of the display panel, the second pads being in contact with the second shared channels; first shared fan-out lines electrically connected to the first shared channels through the first pads, the first shared fan-out lines extending to a fan-out area included in the peripheral area; second shared fan-out lines electrically connected to the second shared channels through the second pads, the second shared fan-out lines extending to the fan-out area; and a plurality of connection lines connecting one-to-one the first shared fan-out lines and the second shared fan-out lines, the plurality of connection lines being in the fan-out area. A jth (j is a natural number) first shared fan-out line among the first shared fan-out lines and a (k+1−j)th (k is a natural number of j or more) second shared fan-out line among the second shared fan-out lines may be connected through one of the connection lines.

According to some example embodiments, in the display device in accordance with the present disclosure, adjacent source drivers share predetermined data lines (e.g., shared data lines) corresponding to a boundary between the adjacent source drivers, and alternately supply a data signal to the shared data lines, so that an output deviation between the adjacent source drivers can be cancelled (removed) and/or minimized. Accordingly, an image quality defect caused by the output deviation between the source drivers can be minimized or reduced.

BRIEF DESCRIPTION OF THE DRAWINGS

Aspects of some example embodiments will now be described more fully hereinafter with reference to the accompanying drawings; however, they may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
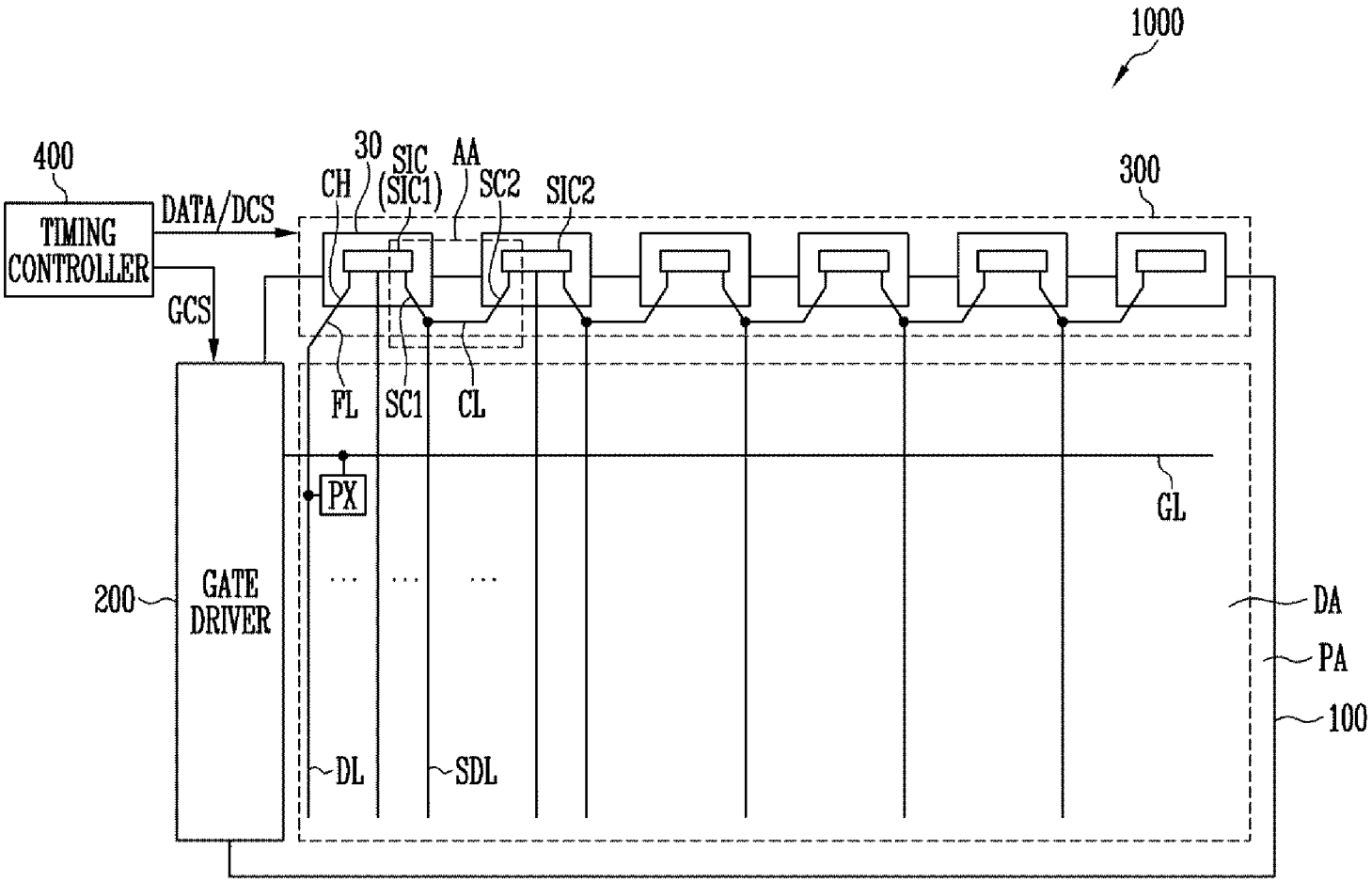
FIG. 1 is a view illustrating a display device in according to some example embodiments of the present disclosure.

Hereinafter, aspects of some example embodiments of the present disclosure will be described in more detail with reference to the accompanying drawings. Throughout the drawings, the same reference numerals are given to the same elements, and their overlapping descriptions will be omitted.

FIG. 1 is a view illustrating a display device in according to some example embodiments of the present disclosure of the present disclosure.

Referring to FIG. 1, the display device 1000 may include a display panel 100, a gate driver 200 (or scan driver), a data driver 300 including a plurality of source drivers SIC, and a timing controller 400.

The display device 1000 may be implemented with an organic light emitting display device including a plurality of organic light emitting devices. However, this is merely illustrative, and the display device 1000 may be implemented with a liquid crystal display device, a plasma display device, a quantum dot display device, a display device including inorganic light emitting devices, or the like.

The display panel 100 may include a display area DA and a peripheral area PA at the periphery of the display area DA. Also, the display panel 100 may include a gate line GL, a data line DL (including a shared data line SDL), and a pixel PX. The pixel PX may be located in an area defined by the gate line GL and the data line DL (or the shared data line SDL).

The pixel PX is electrically connected to the gate line GL and the data line, receives a data signal through the data line DL in response to a gate signal provided through the gate line GL, and controls an emission amount of light supplied from a backlight, corresponding to the data signal, thereby displaying a luminance corresponding to the data signal. For example, the pixel PX may include a switching element, a liquid crystal capacitor, and a storage capacitor. The switching element may be electrically connected to the gate line GL and the data line DL, the liquid crystal capacitor may be connected to the switching element, and the storage capacitor may be connected to the liquid crystal capacitor. However, this is merely illustrative, and the pixel PX may include a switching element, an organic light emitting diode (or inorganic light emitting device), and a storage capacitor.

The gate driver 200 may receive a gate control signal GCS from the timing controller 400, generate a gate signal, based on the gate control signal GCS, and provide the gate signal to the gate line GL. The gate driver 200 may include a shift register configured to sequentially output the gate signal. Although only one gate driver 200 is illustrated in FIG. 1, a plurality of gate drivers 200 may be provided in the display device 1000.

The data driver 300 may receive a data control signal DCS and image data DATA from the timing controller 400, and generate data signals corresponding to the image data DATA. Each of the data signals may be provided to the data line through an output channel CH, and be provided to the shared data line SDL through one of shared channels SC1 and SC2.

The data driver 300 may include a plurality of source drivers SIC. In some embodiments, each of the source drivers SIC may be provided in the form of a driving chip or driving integrated circuit (IC).

According to some example embodiments, each of the source drivers SIC may be mounted on a source driving circuit film 30, and be connected to the timing controller 400 via a printed circuit board and/or a cable. For example, an output channel CH1 and a first shared channel SC1, which are connected to an output terminal of a first source driver SIC1, may be included in a source driving circuit film 30 on which the first source driver SIC1 is mounted. The output channel CH and the first shared channel SC1 may be provided in plurality.

In addition, an output channel CH and a second shared channel SC2, which are connected to an output terminal of a second source driver SIC2, may be included in a source driving circuit film (e.g., designated as 32 in FIG. 2) on which the second source driver SIC2 is mounted. The shared channels SC1 and SC2 refer to portions connected by a connection line CL among a plurality of channels CH.

Meanwhile, according to some example embodiments, the output channel CH and the shared channels SC1 and SC2 may be connected to the data line DL and the shared data line SDL through fan-out lines FL, respectively. The fan-out lines FL may be formed in the peripheral area PA of the display panel 100.

According to some example embodiments, the first shared channel SC1 connected to the first source driver SIC1 and the second shared channel SC2 connected to the second source driver SIC2 may be commonly connected to the shared data line SDL. The first and second shared channels SC1 and SC2 may alternately supply a data signal to the shared data line SDL. In addition, the shared data line SDL refers to a portion connected to the shared channels SC1 and SC2 among data lines.

When the display panel has high resolution and becomes large sized, a difference in data charging time and charge rate occurs between the pixels PX. For example, a large difference in data charge rate between pixels connected to a data line corresponding to a boundary between source drivers SIC occurs due to a characteristic deviation (output deviation) of the plurality of source drivers SIC, a power variation according to a data signal output sequence of the source drivers SIC, etc. Therefore, an image quality defect such as an image variation caused by the difference in charge rate may be viewed or perceived.

In the display device 1000 according to some example embodiments of the present disclosure, adjacent source drivers SIC time-divisionally supply a data signal to a data line (e.g., a predetermined data line) (e.g., a shared data line SDL) corresponding to a boundary between the adjacent source drivers SIC, so that an output deviation between the adjacent source drivers SIC can be cancelled and/or removed. Accordingly, an image quality defect caused by the output deviation between the source drivers SIC can be minimized or reduced.

The timing controller 400 may control the gate driver 200 and the data driver 300 (including the source drivers SIC). The timing controller 400 may receive a control signal (e.g., a control signal including a clock signal) from the outside, and generate the gate control signal GCS and the data control signal DCS, based on the control signal. The timing controller 400 may provide the gate control signal GCS to the gate driver 200, and provide the data control signal DCS to the data driver 300.

Also, the timing controller 400 may generate image data DATA (or frame projection data) by realigning input data (or original image data) provided from the outside (e.g., a graphic processor), and provide the image data DATA to the data driver 300. The timing controller 400 may serially transmit the image data in a packet form to each of the source drivers SIC by using a serial interface (or high-speed serial interface).

According to some example embodiments, in a first driving mode in which any data signal is not supplied from the second shared channel SC2 to the shared data line SDL while a data signal is supplied from the first shared channel SC1 to the shared data line SDL, the timing controller 400 does not change the arrangement sequence of the image data DATA to be supplied to the source drivers SIC but may supply the image data DATA to the source drivers SIC. In a second driving mode in which a data signal is supplied from the second shared channel SC2 to the shared data line SDL while any data signal is not being supplied from the first shared channel SC1 to the shared data line SDL, the timing controller 400 may supply image data DATA corresponding to the second shared channel SC2 (e.g., a plurality of second shared channels) by reversing the arrangement sequence of the image data DATA. Accordingly, a data signal corresponding to an image to be displayed can be accurately supplied from the first source driver SIC1 or the second source driver SIC2 to the shared data line SDL according to a driving mode.

Figure 2:
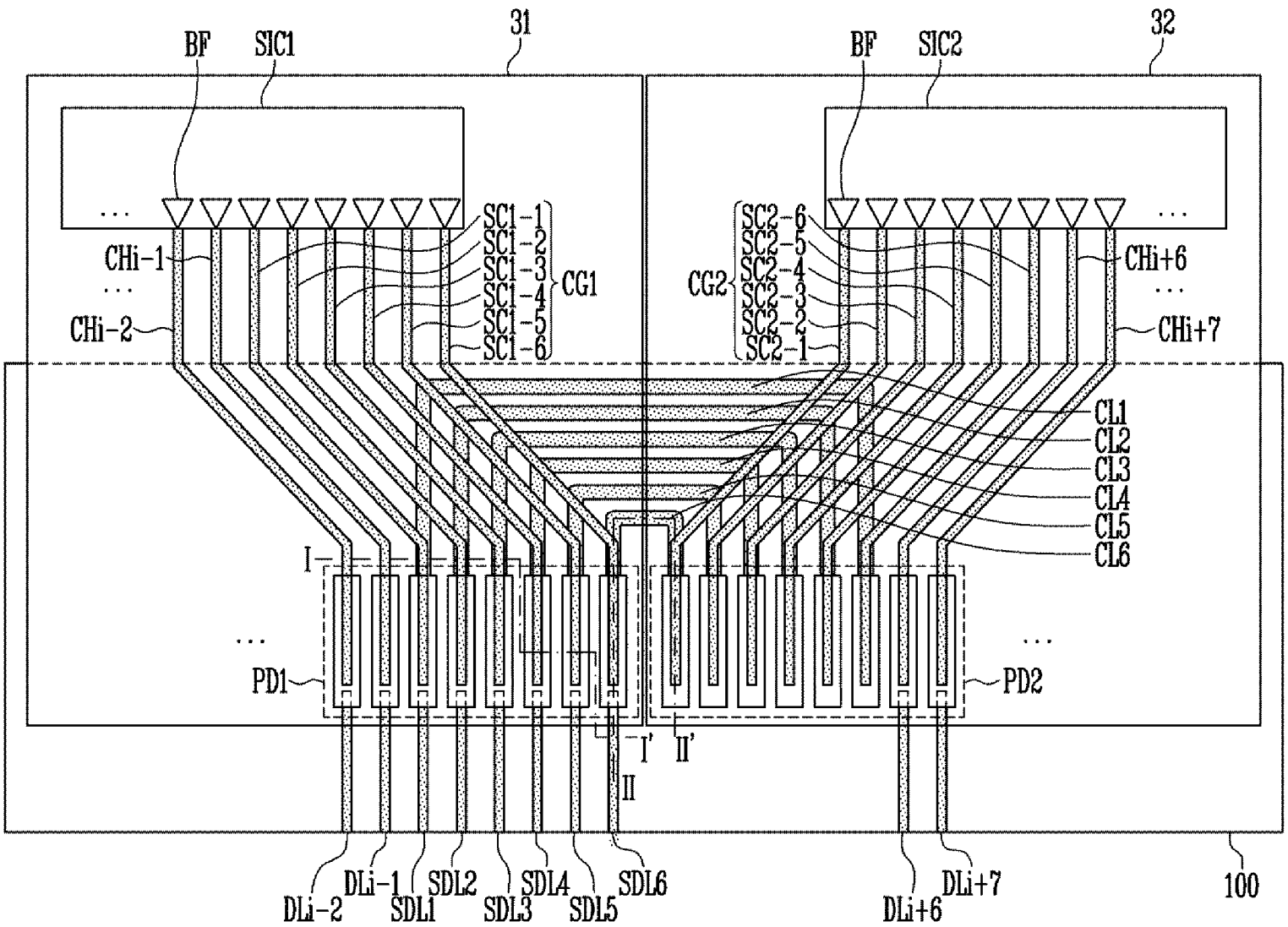
FIG. 2 is an enlarged view schematically illustrating an example of area AA of the display device shown in FIG. 1.

FIG. 2 is an enlarged view schematically illustrating an example of area AA of the display device shown in FIG. 1.

Referring to FIGS. 1 and 2, the first and second source drivers SIC1 and SIC2 adjacent to each other may share first to sixth shared data lines SDL1 to SDL6. Although a case where the first and second source drivers SIC1 and SIC2 share six data lines is illustrated in FIG. 2, the number of shared data lines is not limited thereto.

The first source driver SIC1 may be mounted on a first source driving circuit film 31, and the second source driver SIC2 may be mounted or integrated on a second source driving circuit film 32. The first and second source driving circuit films 31 and 32 may be attached to the display panel 100 in the form of a Tape Carrier Package (TCP), a Chip On Flexible board or Chip On Film (COF), or a Flexible Printed Circuit (FPC).

According to some example embodiments, the first and second source driving circuit films 31 and 32 may be configured with a flexible printed circuit board, and be attached to the display panel 100 while being bent toward a back side of the display panel 100 such that portions of the first and second source driving circuit films 31 and 32 surround one side surface of the display panel 100.

However, this is merely illustrative, and at least one of the first and second source drivers SIC1 and SIC2 may be directly mounted on the peripheral area PA of the display panel 100.

The first source driving circuit film 31 may be connected to first pads PD1 provided on the peripheral area PA. In some embodiments, the first source driving circuit film 31 may include a plurality of output channels CHi−1 and CHi−2 and a plurality of shared channels SC1-1 to SC1-6 (or first shared channels), which are connected between the output terminal of the first source driver SIC1 and the first pads PD1. The first shared channels SC1-1 to SC1-6 may be respectively connected one-to-one to buffers BF included in the output terminal of the first source driver SIC1. The first shared channels SC1-1 to SC1-6 may be defined as a first channel group CG1.

The first source driver SIC1 may supply a data signal to the data line DL through a general output channel CH. For example, an (i−2)th (i is an integer of 2 or more) output channel CHi−2 may be connected to an (i−2)th data line DLi−2 through the first pads PD1, and an (i−1)th output channel CHi−1 may be connected to an (i−1)th data line DLi−1 through the first pads PD1. The first source driver SIC1 may supply a data signal corresponding to the (i−2)th data line DLi−2 to the (i−2)th output channel CHi−2, and supply a data signal corresponding to the (i−1)th data line DLi−1 to the (i−1)th output channel CHi−1. The (i−2)th data line DLi−2 and the (i−1)th data line DLi−1 may be formed in the display panel 100 to extend to the display area DA from the first pads PD1. In some embodiments, fan-out lines that respectively connect the (i−2)th data line DLi−2 and the (i−1)th data line DLi−1 to the first pads PD1 may be further located in the peripheral area PA of the display panel 100. The (i−2)th data line DLi−2 and the (i−1)th data line DLi−1 may be connected to an (i−2)th pixel column and an (i−1)th pixel column, respectively.

The first source driver SIC1 may supply data signals to the shared data lines SDL1 to SDL6 through the first channel group CG1. The first shared channels SC1-1 to SC1-6 included in the first channel group CG1 may be connected to the first to sixth shared data lines SDL1 to SDL6 through the first pads PD1.

The second source driving circuit film 32 may be connected to second pads PD2 provided on the peripheral area PA. In some embodiments, the second source driving circuit film 32 may include a plurality of output channels CHi+6 and CHi+7 and a plurality of shared channels SC2-1 to SC2-6 (or second shared channels), which are connected between the output terminal of the second source driver SIC2 and the second pads PD2. The second shared channels SC2-1 to SC2-6 may be respectively connected one-to-one to buffers BF included in the output terminal of the second source driver SIC2. The second shared channels SC2-1 to SC2-6 may be defined as a second channel group CG2.

An (i+6)th output channel CHi+6 may be connected to an (i+6)th data line DLi+6 through the second pads PD2, and an (i+7)th output channel CHi+7 may be connected to an (i+7)th data line DLi+7 through the second pads PD2. The second source driver SIC2 may supply a data signal corresponding to the (i+6)th data line DLi+6 to the (i+6)th output channel CHi+6, and supply a data signal corresponding to the (i+7)th data line DLi+7 to the (i+7)th output channel CHi+7. The (i+6)th data line DLi+6 and the (i+7)th data line DLi+7 may be formed in the display panel 100 to extend to the display area DA from the second pads PD2. In some embodiments, fan-out lines that respectively connect the (i+6)th data line DLi+6 and the (i+7)th data line DLi+7 to the second pads PD2 may be further located in the peripheral area PA of the display panel 100.

The second source driver SIC2 may supply data signals to the shared data lines SDL1 to SDL6 through the second channel group CG2. The second shared channels SC2-1 to SC2-6 included in the second channel group CG2 may be electrically connected to the first to sixth shared data lines SDL1 to SDL6 through connection lines CL1 to CL6 connected to the second pads PD2. In some embodiments, fan-out lines or data lines extending toward the display panel 100 from some of the second pads PD2 corresponding to the second channel group CG2 are removed (do not exist).

In other words, the number of the shared data lines SDL1 to SDL6 may be a half of the total sum of the numbers of the first and second shared channels SC1-1 to SC1-6 and SC2-1 to SC2-6. For example, as shown in FIG. 2, the total sum of the numbers of the first and second shared channels SC1-1 to SC1-6 and SC2-1 to SC2-6 may be 12, and six shared data lines SDL1 to SDL6 may be connected to the first and second shared channels SC1-1 to SC1-6 and SC2-1 to SC2-6.

In some embodiments, the first and second channel groups CG1 and CG2 may be consecutively arranged. The first shared channels SC1-1 to SC1-6 and the second shared channels SC2-1 to SC2-6 may be consecutively arranged.

The first to sixth shared data lines SDL1 to SDL6 may be formed in the display panel 100 to extend to the display area DA from the first pads PD1. However, this is merely illustrative, and at least some of the first to sixth shared data lines SDL1 to SDL6 may be formed to extend from the second pads PD2 instead of the first pads PD1. The first to sixth shared data lines SDL1 to SDL6 may substantially correspond to ith to (i+5)th data lines (e.g., may be described as DLi to DLi+5). Therefore, the first to sixth shared data lines SDL1 to SDL6 may be connected to ith to (i+5)th pixel columns, respectively.

In some embodiments, the first channel group CG1 and the second channel group CG2 may form a pair to be commonly connected to the shared data lines SDL1 to SDL6. According to some example embodiments, the display panel 100 may include connection lines CL1 to CL6 that connect one-to-one the first shared channels SC1-1 to SC1-6 and the second shared channels SC2-1 to SC2-6. The connection lines CL1 to CL6 may be located in the peripheral area PA of the display panel 100.

According to some example embodiments, the connection lines CL1 to CL6 may be located to overlap with at least portions of the first and second source driving circuit films 31 and 32. However, this is merely illustrative, and at least portions of the connection lines CL1 to CL6 may be located in the peripheral area between the pads PD1 and PD2 and the display area DA.

In some embodiments, all the connection lines CL1 to CL6 may be located in the same layer so as to prevent an increase in number of processes due to addition of the connection lines CL1 to CL6. The connection lines CL1 to CL6 are to be prevented from being in contact with or short-circuited to each other. According to some example embodiments, a jth (j is a natural number of k or less) first shared channel (e.g., SC1-j) of the first channel group CG1 and a (k+1−j)th (k is a natural number) shared channel (e.g., SC2-(k+1−j)) of the second channel group may be connected through one of the connection lines CL1 to CL6.

For example, a first connection line CL1 may electrically connect a first first shared channel SC1-1 and the last second shared channel (i.e., a sixth second shared channel SC2-6). Similarly, a second connection line CL2 may electrically connect a second first shared channel SC1-2 and a fifth second shared channel SC2-5. The other connection lines may connect one-to-one first shared channels and second shared channels, using the same rule. Accordingly, the connection lines CL1 to CL6 can all be formed on the same insulating layer through a one-time process without intersect each other or without being short-circuited to each other.

According to some example embodiments, a first end portion of each of the connection lines CL1 to CL6 may be connected to one of the first pads PD1, and a second end portion of the connection lines CL1 to CL6 may be connected to one of the second pads PD2. Accordingly, each of the first channel groups CG1 and the second channel groups CG2 can supply data signals to the shared data lines SDL1 to SDL6. However, when the first channel group CG1 supplies data signals to the shared data lines SDL1 to SDL6, the data signals are not transferred from the second channel group CG2 to the shared data lines SDL1 to SDL6. In addition, when the second channel group CG2 supplies data signals to the shared data lines SDL1 to SDL6, the data signals are not transferred from the first channel group CG1 to the shared data lines SDL1 to SDL6. A driving method of supplying data signals to the shared data lines SDL1 to SDL6 will be described in detail with reference to the following drawings from FIG. 4A.

Figure 3A:
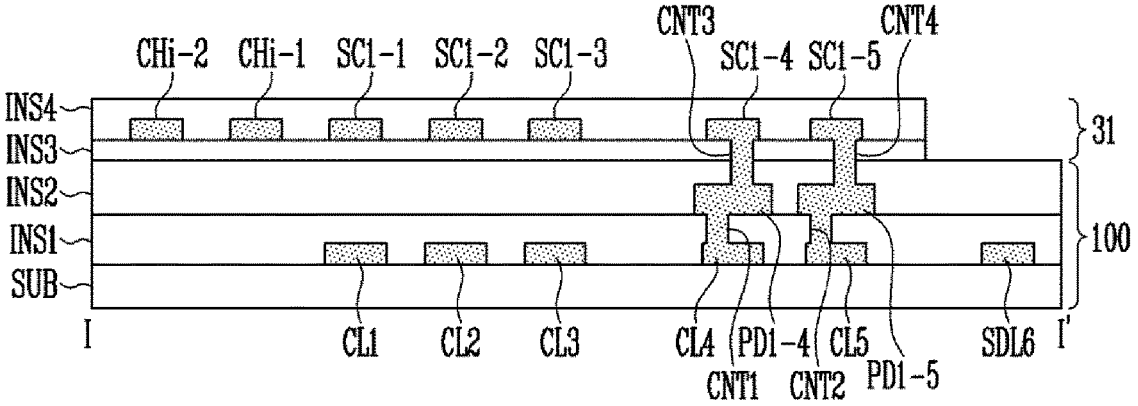
FIG. 3A is a sectional view illustrating an example of the display device shown in FIG. 2, which is taken along the line I-I'.

FIG. 3A is a sectional view illustrating an example of the display device shown in FIG. 2, which is taken along line I-I'.

Referring to FIGS. 1 to 3A, the first source driving circuit film 30 on which the first source driver SIC1 is mounted may be located on a portion of the peripheral area PA of the display panel 100.

The connection lines CL1 to CL6 may be located in the peripheral area PA of the display panel 100 to connect one-to-one the first shared channels SC1-1 to SC1-6 and the second shared channels SC2-1 to SC2-6. For example, first to sixth connection lines CL1 to CL6 may be located on a substrate SUB of the display panel 100. Also, the connection lines CL1 to CL6 may be formed in the same layer through the same process. The connection lines CL1 to CL6 may include a conductive material such as a metal or a transparent conductive material.

Although a case where the connection lines CL1 to CL6 are located on the substrate SUB is illustrated in FIG. 3A, at least one insulating layer and at least one conductive pattern may be located between the connection lines CL1 to CL6 and the substrate SUB. For example, a semiconductor layer, a gate electrode, a signal transfer line, and the like, which constitute a transistor of a pixel, may be located on the bottom of the connection lines CL1 to CL6.

According to some example embodiments, the data line DL shown in FIG. 1 and the shared data line SDL6 shown in FIG. 3A may be located in the same layer as the connection lines CL1 to CL6. However, this is merely illustrative, and the data line DL shown in FIG. 1 and the shared data line SDL6 shown in FIG. 3A may be located in a layer different from that of the connection lines CL1 to CL6.

A first insulating layer INS1 may be located to cover the connection lines CL1 to CL6. The first insulating layer INS1 may include an organic material, an inorganic material, or a mixture of the organic material and the inorganic material.

A plurality of pads PD1-4 and PD1-5 may be located on the first insulating layer INS1. For example, at least portions of (1−4)th and (1−5)th pads PD1-4 and PD1-5 may overlap with the fourth and fifth connection lines CL4 and CL5 corresponding thereto. The (1−4)th and (1−5)th pads PD1-4 and PD1-5 may be some included in the first pads PD1.

The (1−4)th pad PD1-4 may be connected to the fourth connection line CL4 through a first contact hole CNT1 penetrating the first insulating layer INS1. The (1−5)th pad PD1-5 may be connected to the fifth connection line CL5 through a second contact hole CNT2 penetrating the first insulating layer INS1.

A second insulating layer INS2 may cover side surfaces of the first and second pads PD1 and PD2, and be located on the first insulating layer INS1. The second insulating layer INS2 may expose at least portions of upper surfaces of the first and second pads PD1 and PD2. The second insulating layer INS2 may include an organic material, an inorganic material, or a mixture of the organic material and the inorganic material.

The first source driving circuit film 31 including third and fourth insulating layers INS3 and INS4, output channels CHi−1 and CHi−2, and first shared channels SC1-1 to SC1-5 may be located on the display panel 100.

The third and fourth insulating layers INS3 and INS4 may be located to protect the output channels CHi−1 and CHi−2 and the first shared channels SC1-1 to SC1-5 and prevent or reduce instances of a short circuit with other conductive materials.

As shown in FIG. 3A, a fourth first shared channel SC1-4 may be connected to the (1−4)th pad PD1-4 through a third contact hole CNT3 penetrating the second and third insulating layers INS2 and INS3. Similarly, a fifth first shared channel SC1-5 may be connected to the (1−5)th pad PD1-5 through a fourth contact hole CNT4 penetrating the second and third insulating layers INS2 and INS3. For example, the first shared channels SC1-1 to SC1-6 and the first pads PD1 may be electrically connected through an anisotropic conductive film, etc.

As described above, the first shared channels SC1-1 to SC1-6 can be connected to the connection lines CL1 to CL6 through the first pads PD1, respectively.

Figure 3B:
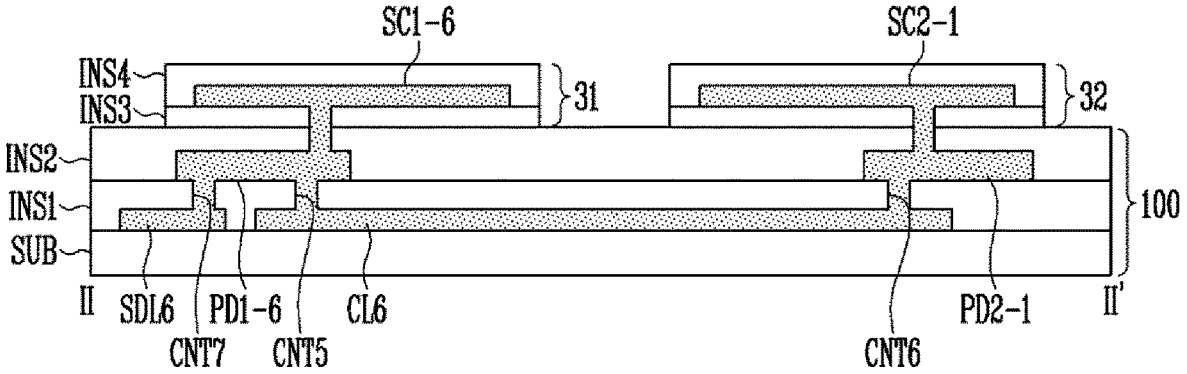
FIG. 3B is a sectional view illustrating an example of the display device shown in FIG. 2, which is taken along line the II-II'.

FIG. 3B is a sectional view illustrating an example of the display device shown in FIG. 2, which is taken along line II-II'.

Referring to FIGS. 1 to 3B, the first shared channels SC1-1 to SC1-6 and the second shared channels SC2-1 to SC2-6 may be connected one-to-one through the connection lines CL1 to CL6.

The shared data lines SDL1 to SDL6 and the connection lines CL1 to CL6 may be located on the substrate SUB. In some embodiments, the shared data lines SDL1 to SDL6 and the connection lines CL1 to CL6 may be located on different insulating lines.

The first pads PD1 and the second pads PD2 may be located on the first insulating layer INS1 covering the connection lines CL1 to CL6. For example, a (1–6)th pad PD1-6 among the first pads PD1 corresponding to the first source driver SIC1 may be connected to the sixth connection line CL6 through a fifth contact hole CNT5, and a (2–1)th pad PD2-1 among the second pads PD2 corresponding to the second source driver SIC2 may be connected to the sixth connection line CL6 through a sixth contact hole CNT6. In addition, the (1–6)th pad PD1-6 may be connected to the sixth shared data line SDL6 through a seventh contact hole CNT7.

A sixth first shared channel SC1-6 located on the first source driving circuit film 31 may be electrically connected to the (1–6)th pad PD1-6. In addition, a first second shared channel SC2-1 located on the second source driving circuit film 32 may be electrically connected to the (2–1)th pad PD2-1.

Accordingly, a data signal transferred through the sixth first shared channel SC1-6 and a data signal transferred through the first second shared channel SC2-1 can be supplied to the pixel through the sixth shared data line SDL6.

Figure 4A:
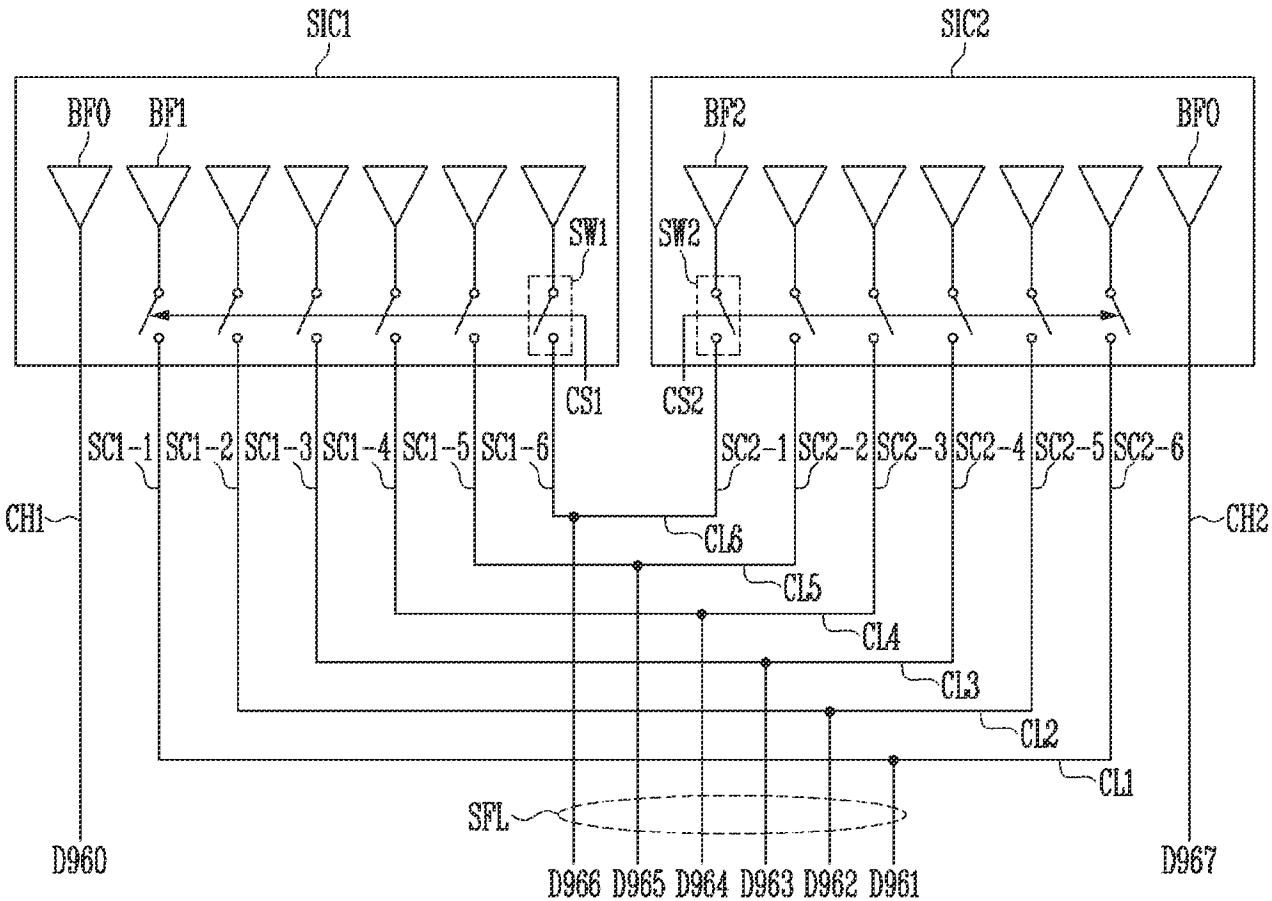
FIG. 4A is a view illustrating an example of connection between source drivers and channels, which are included in the display device shown in FIG. 1.
Figure 4B:
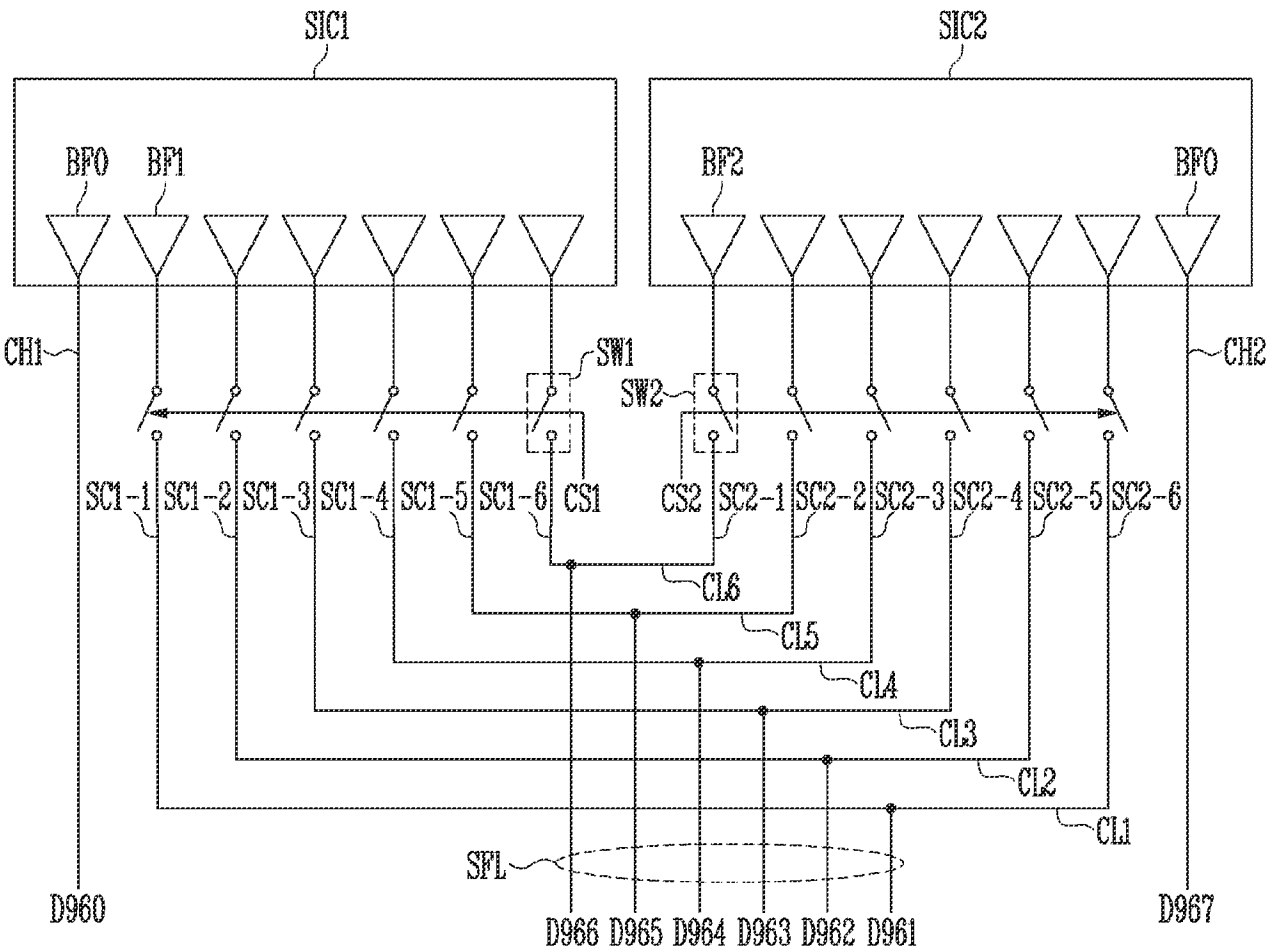
FIG. 4B is a view illustrating an example of the connection between the source drivers and the channels, which are included in the display device shown in FIG. 1.
Figure 5:
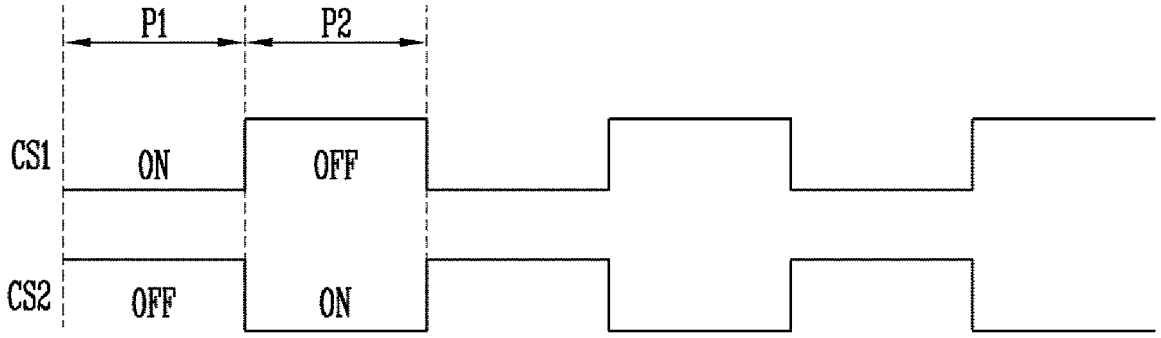
FIG. 5 is a waveform diagram illustrating an example of control signals applied to switches shown in FIGS. 4A and 4B.

FIGS. 4A and 4B are views illustrating examples of connection between the source drivers and the channels, which are included in the display device shown in FIG. 1. FIG. 5 is a waveform diagram illustrating an example of control signals applied to switches shown in FIGS. 4A and 4B.

FIGS. 4A and 4B illustrate only portions of the output terminals of the first and second source drivers SIC1 and SIC2. That is, the first and second source drivers SIC1 and SIC2 may further include a plurality of output channels. For example, each of the first and second source drivers SIC1 and SIC2 may include 966 output channels, and six output channels among the output channels may be defined as the shared channels SC1-1 to SC1-6 or SC2-1 to SC2-6.

A first output channel CH1 of the first source driver SIC1 may be connected to a 960th data line, and transfer a 960th data signal D960 to the 960th data line. The first output channel CH1 may be an output buffer BFO. Meanwhile, a second output channel CH2 of the second source driver SIC2 may be connected to a 967th data line, and transfer a 967th data signal D967 to the 967th data line.

The first to sixth connection lines CL1 to CL6 may be electrically connected to first to sixth shared fan-out lines SFL (and/or the first to sixth shared data lines), respectively.

For example, the first first shared channel SC1-1 and the sixth second shared channel SC2-6 may be connected to the first connection line CL1, and the first connection line CL1 the first shared fan-out line. A 961th data signal D961 may be supplied to a 961th data line through the first shared fan-out line. Similarly, a jth first shared channel and the (k+1–j)th shared channel of the second channel group may be connected through a jth connection line.

According to some example embodiments, as shown in FIG. 4A, the first source driver SIC1 may further include first output buffers BF1 and first switches SW1. The first output buffers BF1 may be electrically connected to the first shared channels SC1-1 to SC1-6, respectively. The first switches SW1 may be respectively connected between the first output buffers BF1 and the first shared channels SC1-1 to SC1-6, and be commonly controlled by a first control signal CS1.

Similarly, the second source driver SIC2 may further include second output buffers BF2 and second switches SW2. The second output buffers BF2 may be electrically connected to the second shared channels SC2-1 to SC2-6, respectively. The second switches may be respectively connected between the second output buffers BF2 and the second shared channels SC2-1 to SC2-6, and be commonly controlled by a second control signal CS2.

According to some example embodiments, the first switches SW1 may be connected to input terminals of the first output buffers BF1. Similarly, the second switches SW2 may be connected to input terminals of the second output buffers BF1.

According to some example embodiments, as shown in FIG. 4B, the first and second switches SW1 and SW2 may be included in the outside of the first and second source drivers SIC1 and SIC2. For example, the first and second switches SW1 and SW2 may be located on the first and second source driving circuit films (e.g., designated as 31 and 32 in FIG. 2).

In addition, at least some of the first switches SW1 may be located between the first shared channels SC1-1 to SC1-6 and the connection lines CL1 to CL6, and at least some of the second switches SW2 may be located between the second shared channels SC2-1 to SC2-6 and the connection lines CL1 to CL6.

According to some example embodiments, the first and second switches SW1 and SW2 may be implemented with one of a p-type transistor and an n-type transistor. As shown in FIG. 5, the first and second switches SW1 and SW2 may be p-type transistors, and be turned on in response to a logic low level of the first and second control signals CS1 and CS2. However, this is merely illustrative, and the first and second switches SW1 and SW2 and the waveforms of the first and second control signals CS1 and CS2 are not limited thereto.

During a first period P1, the first switches SW1 may be turned on and the second switches SW2 may be turned off, in response to the first control signal CS1. Accordingly, in the first period P1, 961th to 966th data signals D961 to D966 can be transferred to the shared fan-out lines SFL through the first shared channels SC1-1 to SC1-6. The first period P1 in which a data signal is transmitted through the first shared channels SC1-1 to SC1-6 may correspond to the first driving mode.

During a second period P2, the second switches SW may be turned on and the first switches SW1 may be turned off, in response to the second control signal CS2. Accordingly, in the second period P2, the 961th to 966th data signals D961 to D966 can be transferred to the shared fan-out lines SFL through the second shared channels SC2-1 to SC2-6. The second period P2 in which a data signal is transmitted through the second shared channels SC2-1 to SC2-6 may correspond to the second driving mode.

According to some example embodiments, each of the first control signal CS1 and the second control signal CS2 may have a turn-on level in a frame period (e.g., a predetermined frame period). For example, each of the first period P1 and the second period P2 may be one frame period. The first and second source drivers SIC1 and SIC2 may alternately supply the data signals D961 to D966 to the shared fan-out lines SFL for every frame.

As described above, some outputs of the first and second source drivers SIC1 and SIC2 share some data lines (i.e., the shared data lines), so that an image quality deviation (spot, etc.) caused by an output deviation between the first and second source drivers SIC1 and SIC2 can be minimized or reduced.

However, in the second driving mode, the 961th data signal D961 is to be supplied through the sixth second shared channel SC2-6, and the 966th data signal D966 is to be supplied through the first second shared channel SC2-1. That is, in the second driving mode, the second shared channels SC2-1 to SC2-6 are connected to the shared fan-out lines SFL and the shared data lines in reverse order. Accordingly, the input order of image data supplied to the second source driver SIC2 is to be realigned.

Figure 6A:
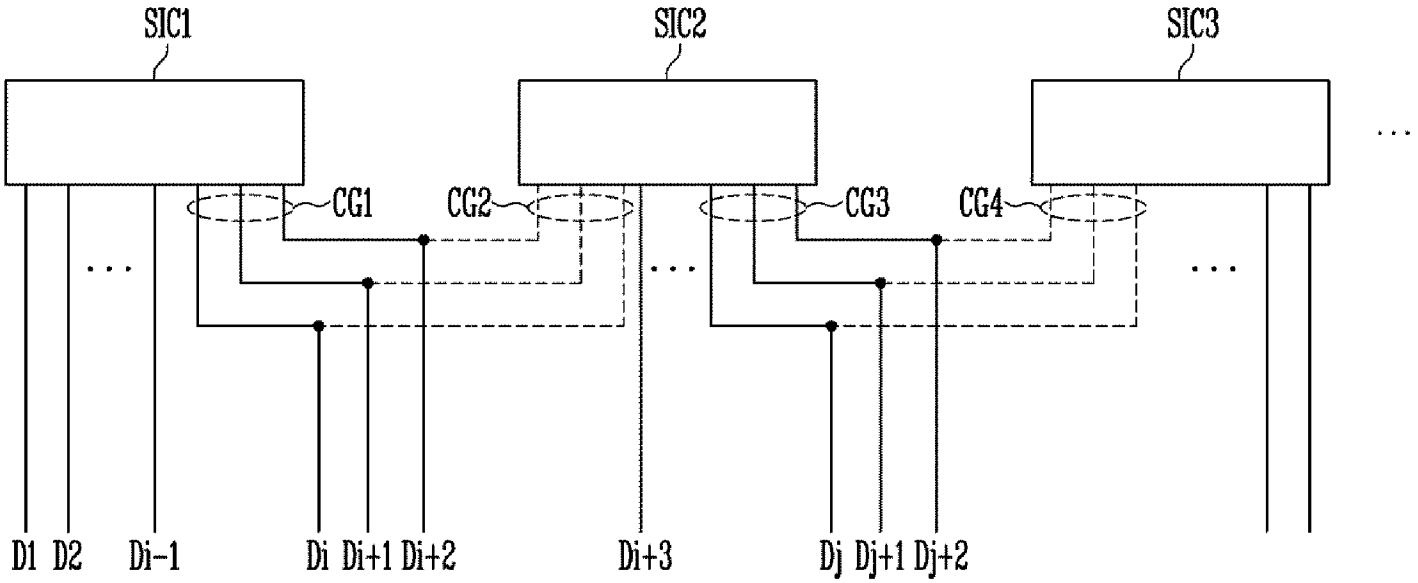
FIGS. 6A and 6B are views illustrating an example in which shared channels output a data signal in a first driving mode.
Figure 6B:
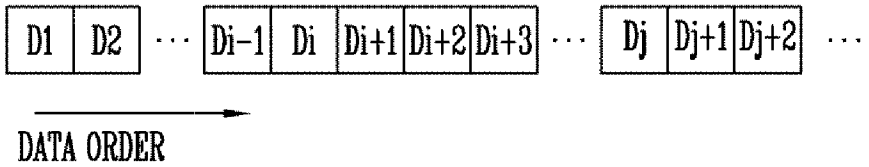
Figure 7A:
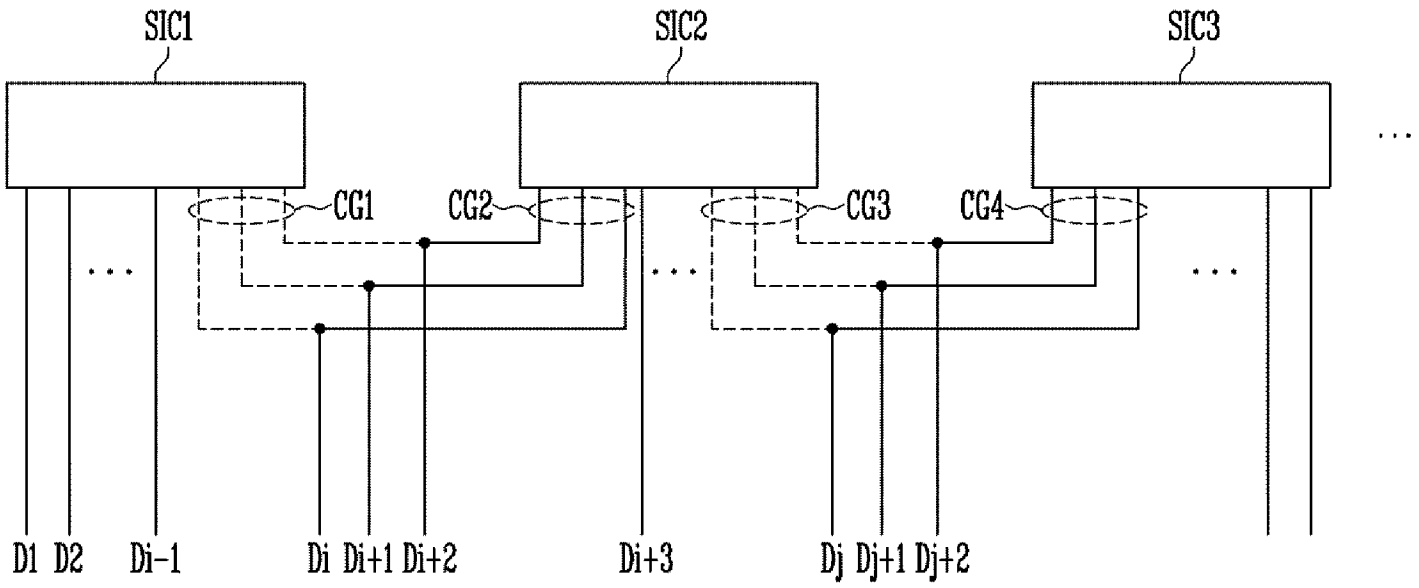
FIGS. 7A and 7B are views illustrating an example in which the shared channels output a data signal in a second driving mode.
Figure 7B:
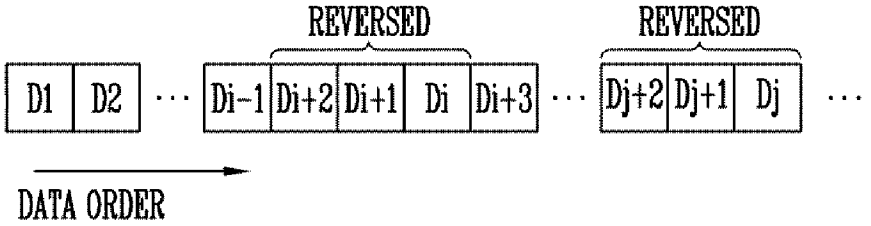

FIGS. 6A and 6B are views illustrating an example in which shared channels output a data signal in the first driving mode. FIGS. 7A and 7B are views illustrating an example in which the shared channels output a data signal in the second driving mode.

Referring to 1, 6A, 6B, 7A, and 7B, only some of channel groups CG1 to CG4 may be electrically connected to data lines (or shared data lines) according to the first driving mode and the second driving mode. Although each of the channel groups CG1 to CG4 includes three shared channels is illustrated in FIGS. 6A to 7B, the number of shared channels are not limited thereto.

The first source driver SIC1 may include a first channel group CG1 including output channels that respectively output first to (i−1)th (i is a natural number greater than 1) data signals D1 to Di−1 and first shared channels that respectively output ith to (i+2)th data signals Di to Di+2. The first shared channels may be connected to an ith to (i+2)th data lines (shared data lines).

The second source driver SIC2 may include a second channel group CG2 that outputs the ith to (i+2)th data signals Di to Di+2. The second channel group CG2 may be connected to the ith to (i+2)th data lines. The second source driver SIC2 may further include a plurality of output channels.

In some embodiments, the display device 1000 may further include a third source driver SIC3 located adjacent to the last output channel of the second source driver SIC2. The second source driver SIC2 may include a third channel group CG3 that outputs a jth (j is a natural number greater than j+3) to (j+2)th data signals Dj to Dj+2. The third channel group CG3 may be connected to the jth to (j+2)th data lines. The jth to (j+2)th data lines may be additional shared data lines.

According to some example embodiments, a driving method of the third channel group CG3 may be substantially identical to that of the first channel group CG1.

The third source driver SIC3 may include a fourth channel group CG4 that outputs the jth to (j+2)th data signals Dj to Dj+2. The fourth channel group CG4 may be connected to the jth to (j+2)th data lines. According to some example embodiments, a driving method of the fourth channel group CG4 may be substantially identical to that of the second channel group CG2.

As shown in FIG. 6A, in the first driving mode, the first channel group CG1 may be electrically connected to the ith to (i+2)th data lines, and the third channel group CG3 may be electrically connected to the jth to (j+2)th data lines. Electrical connection between the second channel group CG2 and the second source driver SIC2 is interrupted, and electrical connection between the fourth channel group CG4 and the third source driver SIC3 is interrupted. The first source driver SIC1 may supply the ith to (i+2)th data signals Di to Di+2 to pixels corresponding thereto through the first channel group CG1, and the second source driver SIC2 may supply the jth to (j+2)th data signals Dj to Dj+2 to pixels corresponding thereto through the third channel group CG3.

The timing controller 400 may transmit image data DATA in a packet form to the source drivers SIC1 to SIC3 by using a serial interface, etc. As shown in FIG. 6B, in the first driving mode, the timing controller 400 may supply ith to (i+2)th image data corresponding to the ith to (i+2)th data lines (shared data lines) to the first source driver SIC1.

As shown in FIG. 7A, in the second driving mode, the second channel group CG2 may be electrically connected to the ith to (i+2)th data lines, and the fourth channel group CG4 may be electrically connected to the jth to (j+2)th data lines. Electrical connection between the first channel group CG1 and the first source driver SIC1 is interrupted, and electrical connection between the third channel group CG3 and the second source driver SIC2 is interrupted. The second source driver SIC2 may supply the ith to (i+2)th data signals Di to Di+2 to pixels corresponding thereto through the second channel group CG2, and the third source driver SIC3 may supply the jth to (j+2)th data signals Dj to Dj+2 to pixels corresponding thereto through the fourth channel group CG4.

As shown in FIG. 7B, in the second driving mode, the timing controller 400 may supply ith to (i+2)th image data corresponding to the ith to (i+2)th data lines to the second source driver SIC2. As described with reference to FIGS. 2 and 4, the second channel group CG2 is connected to the ith to (i+2)th data lines in reverse order, and hence the order of image data supplied to the second channel group CG2 may be reversed. That is, the timing controller 400 may supply the image data DATA to the second source driver SIC2 in an order of the (i+2)th image data, the (i+1)th image data, and the ith image data. The order of another image data DATA supplied to the second source driver SIC2 is not changed.

For example, when the ith to (i+2)th data signals Di to Di+2 respectively correspond to R, G, and B, in the second driving mode, the timing controller 400 may supply the image data DATA to the second source driver SIC2 in an order of B→G→R.

A first shared channel of the second channel group CG2 may output the (i+2)th data signal Di+2, and a third shared channel of the second channel group CG2 may output the ith data signal Di.

Similarly, ith to (i+2)th image data corresponding to the jth to (j+2)th data lines may be supplied to the fourth channel group CG4 of the third source driver SIC3 in reverse order.

Accordingly, data signals respectively corresponding to data lines can be accurately transferred to pixels in the first driving mode and the second driving mode.

Figure 8:
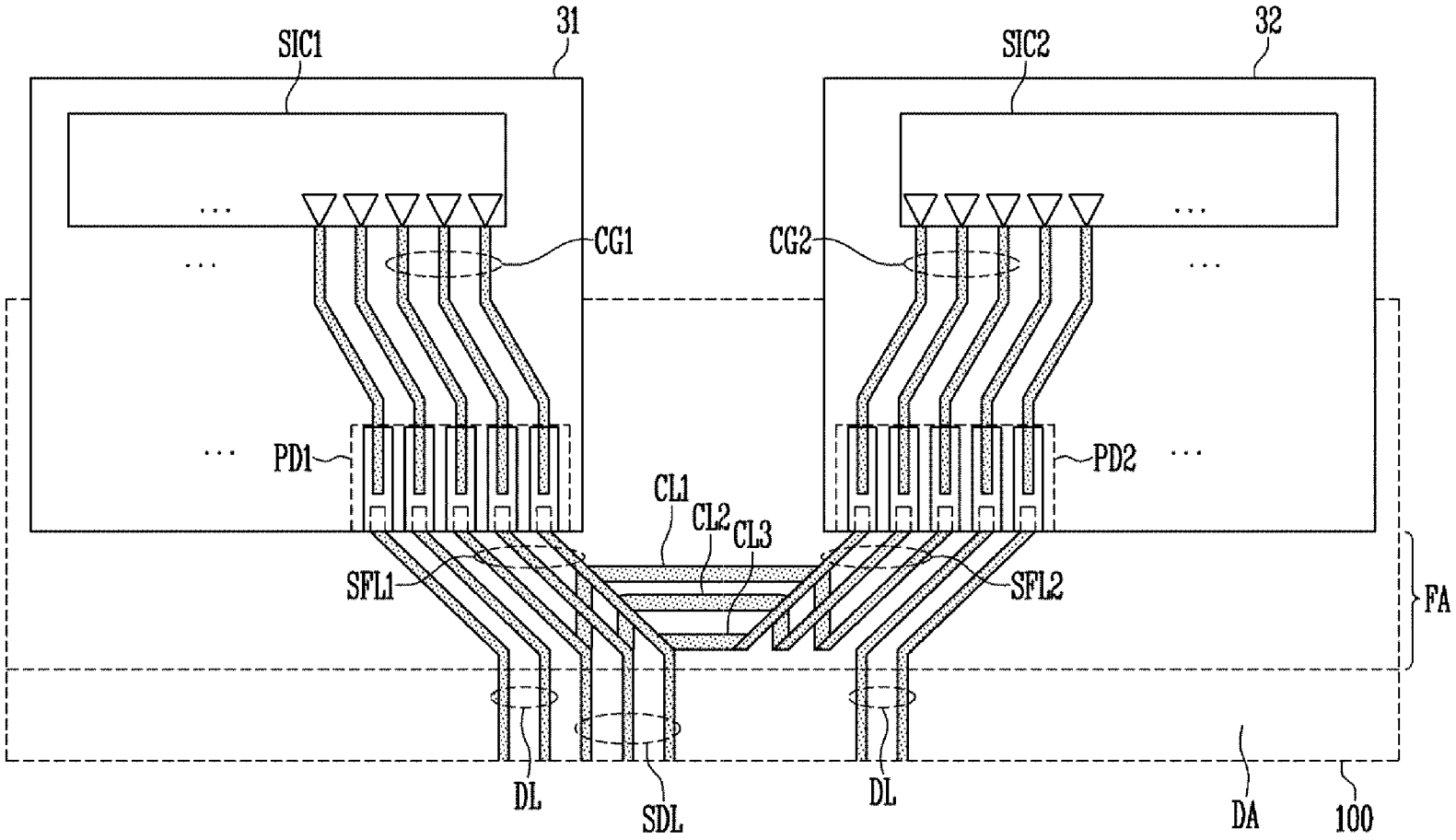
FIG. 8 is an enlarged view schematically illustrating an example of the area AA of the display device shown in FIG. 1.

FIG. 8 is an enlarged view schematically illustrating an example of the area AA of the display device shown in FIG. 1.

The display device in accordance with this embodiment is identical to the display device shown in FIG. 2, except positions at which connection lines are located. Therefore, components identical or corresponding to those of the display device shown in FIG. 2 are designated by like reference numerals, and overlapping descriptions will be omitted.

Referring to FIG. 8, a first source driving circuit film 31 may be connected to first pads PD1 provided on the peripheral area PA. A second source driving circuit film 32 may be connected to second pads PD2 provided on the peripheral area PA.

A first channel group CG1 including first shared channels may connect a first source driver SIC1 and the first pads PD1. The first channel group CG1 is located on the first source driving circuit film 31. A second channel group CG2 including second shared channels may connect a second source driver SIC2 and the second pads PD2. The second channel group CG2 is located on the second source driving circuit film 32.

The display panel 100 may include the first pads PD1 in contact with the first shared channels and the second pads PD2 in contact with the second shared channels. The first and second pads PD1 and PD2 may be located in the peripheral area PA.

The display panel 100 may further include first shared fan-out lines SFL1 and second shared fan-out lines SFL2. The first shared fan-out lines SFL1 may be electrically connected to the first shared channels (first channel group CG1), and extend to a fan-out area FA included in the peripheral area PA. The second shared fan-out lines SFL2 may be electrically connected to the second shared channels (second channel group CG2), and extend to the fan-out area FA included in the peripheral area PA.

The display panel 100 may further include a plurality of connection lines CL1, CL2, and CL3. The connection lines CL1, CL2, and CL3 may respectively connect one-to-on the first shared fan-out lines SFL1 and the second shared fan-out lines SFL2. The connection lines CL1, CL2, and CL3 may be located in the fan-out area FA. When the distance between the first and second source drivers SIC1 and SIC2 is relatively distant, the connection lines CL1, CL2, and CL3 may be located in the fan-out area FA. In addition, first terminals of the connection lines CL1, CL2, and CL3 may be respectively connected to the first shared fan-out lines SFL1, and second terminals of the connection lines CL1, CL2, and CL3 may be respectively connected to the second shared fan-out lines SFL2.

According to some example embodiments, the connection lines CL1, CL2, and CL3 and the first and second shared fan-out lines SFL1 and SFL2 may be located on different insulating layers of the display panel 100. Accordingly, instances of a short circuit between the fan-out lines may be prevented or reduced.

A jth (j is a natural number) first shared fan-out line among the first shared fan-out lines SFL1 and a (k+1−j)th (k is a natural number of j or more) second shared fan-out line among the second shared fan-out lines SFL2 may be connected through one of the connection lines CL1, CL2, and CL3.

As described above, in the display device in according to some example embodiments of the present disclosure, adjacent source drivers SIC1 and SIC2 share data lines (e.g., predetermined data lines) (e.g., shared data lines SDL) corresponding to a boundary between the adjacent source drivers SIC1 and SIC2, and alternately supply a data signal to the shared data lines SDL, so that an output deviation between the adjacent source drivers SIC1 and SIC2 can be cancelled and/or removed. Accordingly, an image quality defect caused by the output deviation between the source drivers SIC1 and SIC2 can be minimized or reduced.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. A display device comprising:

a display panel including a display area having a plurality of pixels connected to a plurality of data lines and a peripheral area at the periphery of the display area;

a first channel group including a plurality of first shared channels respectively connected to shared data lines among the data lines;

a second channel group including a plurality of second shared channels respectively connected to the shared data lines;

a first source driver connected to the first channel group, the first source driver being configured to supply data signals to the shared data lines through the first channel group;

a second source driver connected to the second channel group, the second source driver being configured to supply the data signals to the shared data lines through the second channel group, wherein the first channel group and the second channel group forms a pair to be commonly connected the shared data lines; and a plurality of connection lines in the peripheral area connecting the first shared channels with corresponding ones of the second shared channels.

2. The display device of claim 1, wherein the display panel comprises:

the plurality of connection lines in the peripheral area to connect one-to-one the first shared channels and the second shared channels;

a first insulating layer covering the connection lines;

a plurality of pads on the first insulating layer, the plurality of pads being connected to the connection lines through contact holes penetrating the first insulating layer; and a second insulating layer covering side surfaces of the pads, the second insulating layer being on the first insulating layer, wherein the first and second channel groups are on the second insulating layer, and are in contact with each of the pads.

3. The display device of claim 2, wherein a jth (j is a natural number) shared channel of the first channel group and a (k+1−j)th (k is a natural number of j or more) shared channel of the second channel group are connected through one of the connection lines.

4. The display device of claim 3, wherein the first and second channel groups are consecutively arranged corresponding to the pads.

5. The display device of claim 2, wherein the pads include:

a plurality of first pads in contact with the respective first shared channels; and a plurality of second pads in contact with the respective second shared channels.

6. The display device of claim 5, wherein a first end portion of each of the connection lines is connected to one of the first pads, and a second end portion of each of the connection lines is connected to one of the second pads.

7. The display device of claim 5, wherein the connection lines are in the same layer.

8. The display device of claim 5, wherein the display panel includes a plurality of shared fan-out lines extending from the first pads or the second pads to be respectively connected to the shared data lines.

9. The display device of claim 8, wherein the number of the shared fan-out lines is a half of a total sum of the numbers of the first and second shared channels, and wherein the number of the shared data lines is the same as the number of the shared fan-out lines.

10. The display device of claim 1, wherein the first source driver comprises:

a plurality of first output buffers electrically connected to the respective first shared channels; and a plurality of first switches respectively connected between the first output buffers and the first shared channels, the plurality of first switches being commonly controlled by a first control signal, wherein the second source driver comprises:

a plurality of second output buffers electrically connected to the respective second shared channels; and a plurality of second switches respectively connected between the second output buffers and the second shared channels, the plurality of second switches being commonly controlled by a second control signal.

11. The display device of claim 10, wherein the second switches are turned off when the first switches are turned on, and the first switches are turned off when the second switches are turned on.

12. The display device of claim 11, wherein each of the first control signal and the second control signal has a turn-on level in a predetermined frame period.

13. The display device of claim 10, wherein, in a first driving mode in which the first switches are turned on, the data signals are supplied to the shared data lines through the first shared channels, wherein, in a second driving mode in which the second switches are turned on, the data signals are supplied to the shared data lines through the second shared channels.

14. The display device of claim 13, further comprising:

a timing controller configured to serially supply first to kth image data corresponding to first to kth shared data lines to the first source driver in the first driving mode.

15. The display device of claim 14, wherein the timing controller is configured to supply the first to kth image data to the second source driver in reverse order of an arrangement order in the first driving mode in the second driving mode.

16. The display device of claim 15, wherein the timing controller is configured to supply image data corresponding to the other data lines except the first to kth shared data lines to the first and second source drivers without reversing the arrangement order regardless of the driving mode.

17. The display device of claim 12, further comprising:

a third channel group including third shared channels respectively connected to additional shared data lines;

a fourth channel group including fourth shared channels respectively connected to the additional shared data lines; and a third source driver connected to the fourth channel group, the third source driver being configured to supply data signals to the additional shared data lines through the fourth channel group, wherein the third shared channels are connected to the second source driver.

18. The display device of claim 17, wherein, in a first driving mode, the second source driver is configured to supply the data signals to the additional shared data lines through the third shared channels, wherein, in the second driving mode, the third source driver is configured to supply the data signals to the additional shared data lines through the fourth shared channels.

19. The display device of claim 1, further comprising:

a plurality of first switches respectively connected between the first shared channels and a plurality of first output buffers included in the first source driver, the plurality of first switches being commonly controlled by a first control signal; and a plurality of second switches respectively connected between the second shared channels and a plurality of second output buffers included in the second source driver, the plurality of second switches being commonly controlled by a second control signal.

20. The display device of claim 1, wherein the display panel further includes:

a plurality of first pads in the peripheral area of the display panel, the first pads being in contact with the first shared channels;

a plurality of second pads in the peripheral area of the display panel, the second pads being in contact with the second shared channels;

first shared fan-out lines electrically connected to the first shared channels through the first pads, the first shared fan-out lines extending to a fan-out area included in the peripheral area;

second shared fan-out lines electrically connected to the second shared channels through the second pads, the second shared fan-out lines extending to the fan-out area; and a plurality of connection lines connecting one-to-one the first shared fan-out lines and the second shared fan-out lines, the plurality of connection lines being in the fan-out area, wherein a jth (j is a natural number) first shared fan-out line among the first shared fan-out lines and a (k+1−j)th (k is a natural number of j or more) second shared fan-out line among the second shared fan-out lines are connected through one of the connection lines.

* * * * *